United States Patent [19]

Hummel

[11] Patent Number: 4,961,900

[45] Date of Patent: Oct. 9, 1990

[54] CAN FOR RECEIVING A CLUSTER OF FUEL RODS CONTAINING NUCLEAR FUEL

[75] Inventor: Wolfgang Hummel, Weisendorf, Fed. Rep. of Germany

[73] Assignee: Siemens Aktiengesellschaft, Munich, Fed. Rep. of Germany

[21] Appl. No.: 330,775

[22] Filed: Mar. 30, 1989

[30] Foreign Application Priority Data

Mar. 31, 1988 [DE] Fed. Rep. of Germany ..... 3811104

[51] Int. Cl.[5] ..... G21F 5/00

[52] U.S. Cl. ..... 376/272; 250/506.1

[58] Field of Search ..... 376/272; 250/506.1, 250/507.1

[56] References Cited

U.S. PATENT DOCUMENTS

| | | | |
|---|---|---|---|
| 3,483,380 | 12/1969 | Antonsen et al. | 376/272 |
| 4,508,679 | 4/1985 | Matzner et al. | 376/446 |
| 4,560,532 | 12/1985 | Barry et al. | 376/446 |
| 4,636,351 | 1/1987 | Rohr | 376/272 |
| 4,723,358 | 2/1988 | Jung et al. | 376/272 |

FOREIGN PATENT DOCUMENTS

| | | | |
|---|---|---|---|
| 0128236 | 12/1984 | European Pat. Off. . | |
| 0193041 | 9/1986 | European Pat. Off. . | |
| 3506584 | 8/1986 | Fed. Rep. of Germany . | |
| 60-256096 | 12/1985 | Japan | 376/272 |
| 0458552 | 8/1968 | Switzerland . | |

*Primary Examiner*—Daniel D. Wasil

*Attorney, Agent, or Firm*—Herbert L. Lerner; Laurence A. Greenberg

[57] ABSTRACT

A can for receiving a cluster of fuel rods containing nuclear fuel includes a can top, a can jacket secured on the can top, and a can bottom loosely covered by the can jacket. A tie rod is disposed inside the can jacket, and a push plate is disposed inside the can jacket at a right angle to the tie rod. The push plate is for pushing fuel rods out of the can jacket. The tie rod extends loosely through the push plate and has an upper end releasably secured to the can top and a lower end secured to the can bottom. A stop body is loosely attached to the upper end of the tie rod and limits movement of the push plate inside the can jacket.

6 Claims, 4 Drawing Sheets

CAN FOR RECEIVING A CLUSTER OF FUEL RODS CONTAINING NUCLEAR FUEL

The invention relates to a can for receiving fuel rods containing nuclear fuel, including a car top, a can jacket secured on the can top, and a can bottom over which the can jacket is loosely folded.

Such a can is known from FIG. 3 of German Published, Non-Prosecuted Application DE-OS No. 35 06 584. The jacket of that prior art can is undetachably secured to the top of the can, while the bottom of the can has a locking device that can engage a detent opening on the jacket under the influence of a restoring spring.

While suspended from a lifting and transport apparatus, the empty can is first inserted with the bottom part thereof underwater into a recess in the bottom of a holder basket. There, an actuating rod reaches through the locking device of the can bottom and releases the locking engagement of the can bottom and the can jacket. Next, the can top and the can jacket secured thereto is taken back out of the holder basket with the lifting and transport apparatus and moved to the side, while the can bottom is firmly retained in the recess in the bottom of the holder basket by the actuating rod.

A cluster of fuel rods, which may contain spent nuclear fuel and which have a vertical longitudinal axis or in other words an axis at right angles to the can bottom, is then mounted in a tight packing on the can bottom and held in the tight packing by means of pressure strips, which are attached laterally in the holder basket in such a way that they are movable in and out on piston rods of cylinders. Next, the can jacket, which is open at the bottom and is suspended with the can top on the lifting and transporting apparatus, is thrust from top to bottom through the fuel rods that are retained in a tight packing in the holder basket. In this process, the pressure strips attached laterally in the holder basket are correspondingly moved successively from top to bottom away from the fuel rod cluster. Finally, the can jacket is folded over the can bottom in the recess on the bottom of the holder basket, and the locking device is released by the actuating rod, so that the can bottom is again in detent engagement with the can jacket.

Since the can, which is once again closed with the can bottom, is filled with the fuel rods in a tight packing, problems can arise in discharging the fuel rods from the can again, for instance in the course of disposing of them. This is because as a rule, once the can bottom has been removed, they no longer readily drop out of the jacket of the can on their own.

It is accordingly an object of the invention to provide a can for receiving a cluster of fuel rods containing nuclear fuel, which overcomes the hereinafore-mentioned disadvantages of the heretofore-known devices of this general type and which further refines the prior art can in such a way that fuel rods packed tightly therein can be discharged safely and without difficulty once again.

With the foregoing and other objects in view there is provided, in accordance with the invention, a can for receiving a cluster of fuel rods containing nuclear fuel, comprising a can top, a can jacket secured on the can top, a can bottom over which the can jacket is loosely folded, a tie rod disposed inside the can jacket, a push plate disposed inside the can jacket at a right angle to the tie rod, the tie rod extending loosely through the push plate and having an upper end releasably secured to the can top and a lower end secured to the can bottom, and a stop body loosely attached to the upper end of the tie rod and associated with the push plate inside the can jacket.

In order to discharge fuel rods tightly packed in the can according to the invention, the can can be placed in a tub. Subsequent to loosening the fastening of the top end of the tie rod to the can top, the can top and can bottom are pulled apart, so that the fuel rods tightly packed in the can can be pushed out of the can jacket with the push plate and collected in the tub.

In accordance with another feature of the invention, the tie rod is releasably secured to the can bottom.

In accordance with a further feature of the invention, the stop body is a nut screwed onto the tie rod.

In accordance with an added feature of the invention, the can top has an upper surface, and the tie rod extends loosely through the can top, and there is provided a nut screwed on the upper end of the tie rod on the upper surface of the can top for retaining the tie rod.

In accordance with a concomitant feature of the invention, the can bottom has an outer surface, and there is provided a flanged nut screwed on the lower end of the tie rod, the flanged nut having a flange resting on the outer surface of the can bottom, and a pin engaging inside the flange and inside the can bottom for securing the flanged nut against twisting.

Other features which are considered as characteristic for the invention are set forth in the appended claims.

Although the invention is illustrated and described herein as embodied in a can for receiving a cluster of fuel rods containing nuclear fuel, it is nevertheless not intended to be limited to the details shown, since various modifications and structural changes may be made therein without departing from the spirit of the invention and within the scope and range of equivalents of the claims.

The construction and method of operation of the invention, however, together with additional obJects and advantages thereof will be best understood from the following description of specific embodiments when read in connection with the accompanying drawings.

Figure 1:
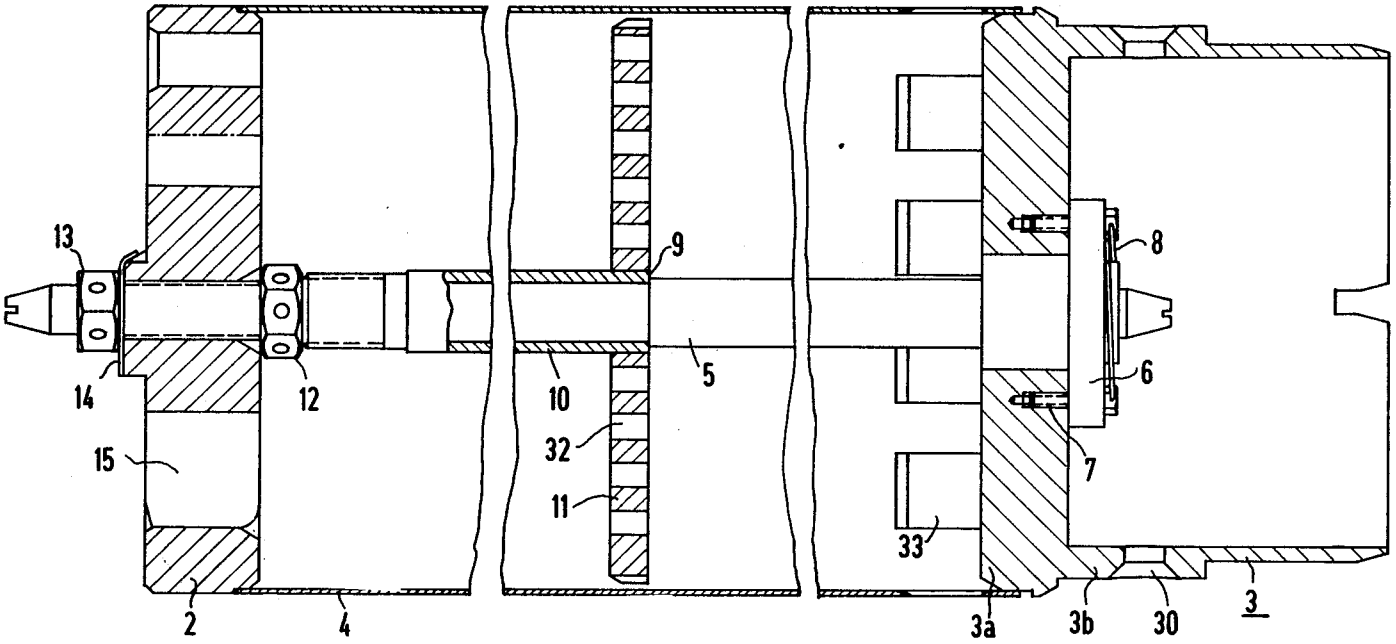
FIG. 1 is a fragmentary, diagrammatic, longitudinal-sectional view of a can taken along the line I—I of FIG. 2, in the direction of the arrows.
Figure 2:
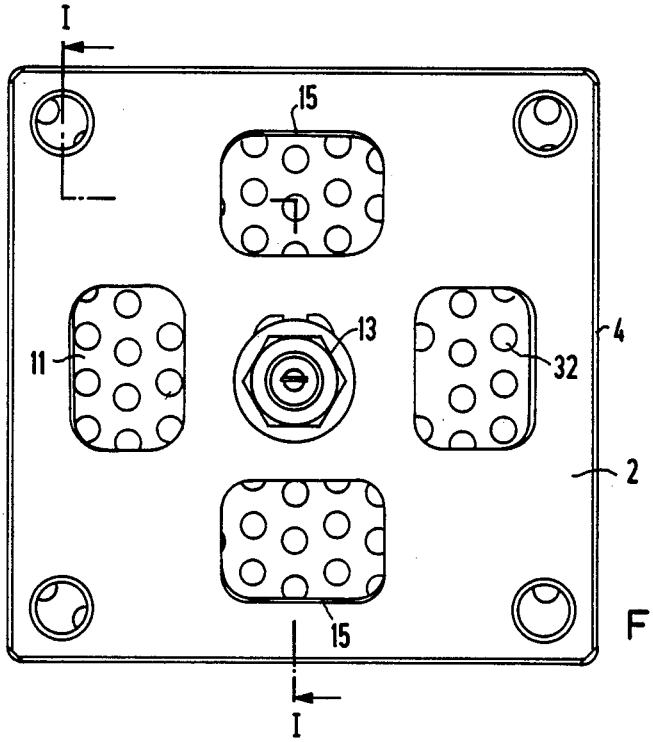
FIG. 2 is a top-plan view of the can of FIG. 1.
Figure 3:
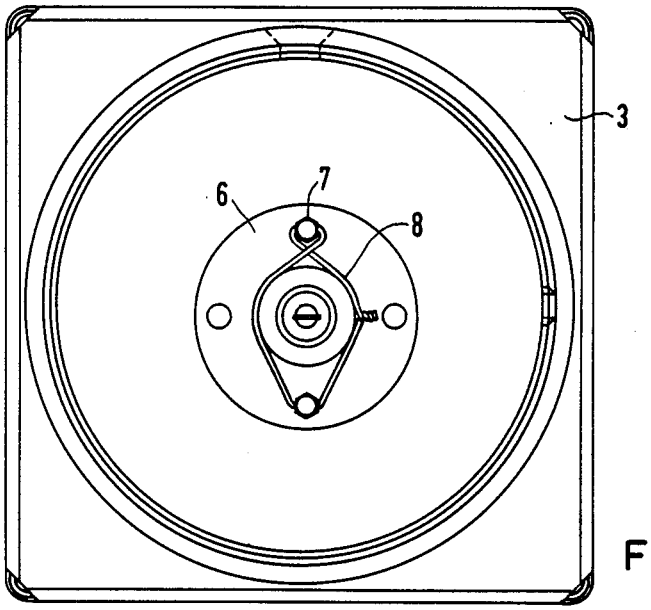
FIG. 3 is a bottom-plan view of the can of FIG. 1.

Referring now to the figures of the drawings in detail and first, particularly, to FIGS. 1–3 thereof, there is seen a can having a plate-like can top 2 and a can bottom 3 that has a plate 3*a* parallel to the can top 2. The cross section of the can top 2 and of the plate 3*a* of the can bottom 3 is square. The can top 2 and plate 3*a* also have an identical contour. The can bottom 3 furthermore has a jacket 3*b* on the outside of the plate 3*a*, which also has a square cross section.

A can jacket or shell 4 with a square cross section is folded over or cuffed at both the can top 2 and the can bottom 3 and in each case is seated in respective steps on the outer surface of the can top 2 and the bottom 3. While the can jacket 4 is firmly welded to the can top 2, the can jacket 4 is only loosely folded over at the can bottom 3.

A tie rod 5 has a thread on both ends. The top end of the tie rod 5 extends loosely through the can top 2. The bottom end of the tie rod 5 is screwed into a flanged nut 6 and extends loosely but without play through the plate 3*a* and therefore through the can bottom 3. The flanged nut 6 is secured against twisting by pins in the form of screws 7. The screws 7 extend through the flange of the flanged nut 6, which rests on the outside of the plate 3*a* and therefore of the can bottom 3. The screws extend and are screwed into the plate 3*a* of the can bottom 3 so that the flange and therefore the flanged nut 6 are screwed firmly thereto. A securing wire 8 reaches through transverse bores in the heads of the screws 7 on the outside of the plate 3*a*.

There is a step 9 on the upper end of the tie rod 5 between the threads at both ends of the tie rod 5. A sheath 10 is slipped loosely over the step 9 and the end of the sheath oriented toward the can bottom 3 reaches through a push plate 11 which is firmly welded to the outside of the sheath end. The push plate 11, which is disposed at a right angle to the tie rod 5, also has a square cross section and extends with pronounced play as far as the inside of the jacket 4 of the can. On the tie rod 5, which reaches loosely through the sheath 10, and thus through the push plate 11 as well, the sheath 10 is limited in movement by a stop body, which is a nut 12 that is screwed onto the thread on the upper end of the tie rod 5 at the inside of the can top 2.

On the outside of the can top 2, the can top 2 is secured with a further nut 13, which is also screwed onto the thread on the upper end of the tie rod 5 and is secured against loosening by itself by means of a securing plate 14 attached to the nut 13. The securing plate 14 is located on the nut 13. A protrusion on the outside of the can top 2 is penetrated by the upper end of the tie rod 5. The securing plate 14 rests on an incline that is formed on the outer surface of the protrusion.

Figure 4:
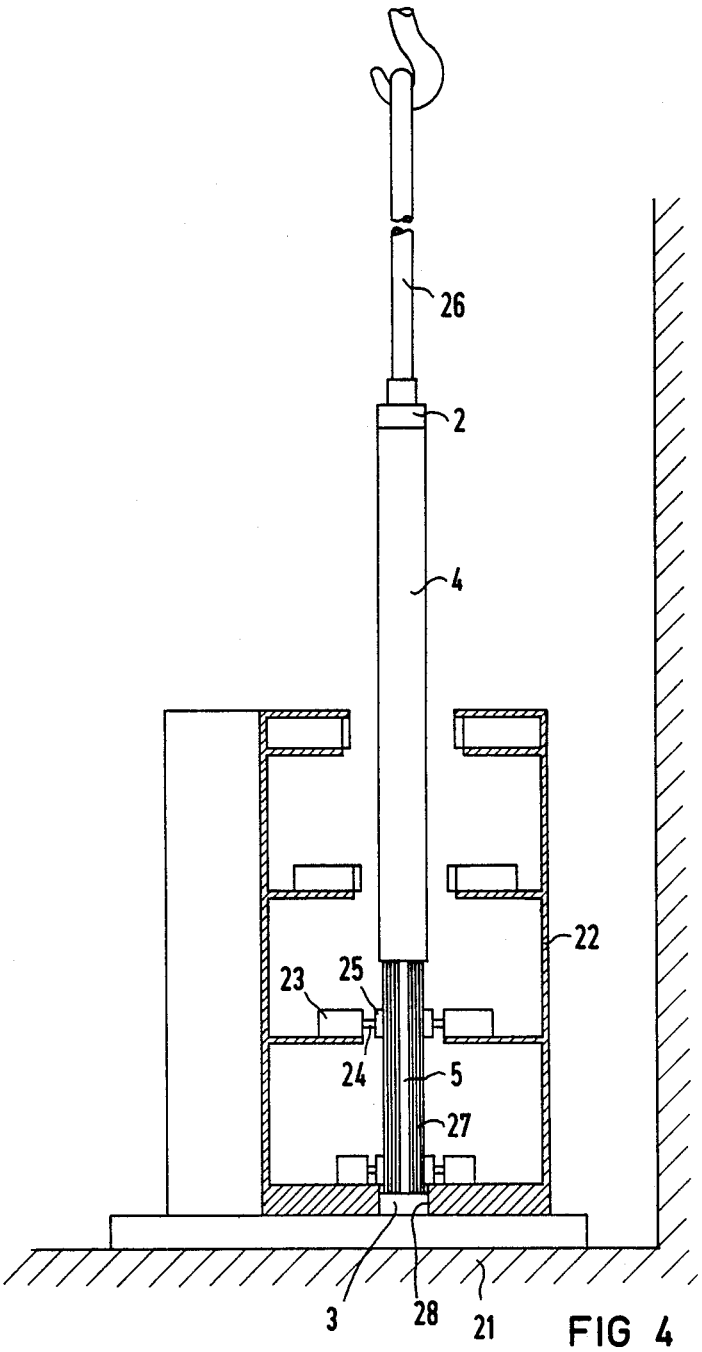
FIG. 4 is a longitudinal-sectional view of a holder basket for inserting fuel rods into a can as shown in FIGS. 1–3.

In FIG. 4, a holder basket 22 with square cross section that is shown in longitudinal section, is located on the bottom 21 of a water-filled tank. On all four inner sides of the holder basket 22, cylinders 23 having non-illustrated displaceable pistons and piston rods 24 are disposed one above the other, each piston rod supporting one horizontal pressure strip 25. Two cylinders, with pressure strips 25 located in pairs facing one another, are provided in each cross-sectional plane of the holder basket 22. These cylinders can be acted upon at both ends of the piston located therein by a hydraulic medium.

A manipulator gripper 26 located above the tank is able to grip the can top 2 of FIGS. 1–3 from behind, through two openings 15 in the can top 2 that are parallel to the tie rod 5. The manipulator gripper 26 is then able to lift the can, so that the can is suspended on the manipulator gripper 26 with the longitudinal axis of the tire rod 5 being vertical. Such a can which is suspended on the manipulator gripper 26, is first lowered into the empty holder basket 22, in which all of the piston rods 24 have been retracted into the cylinders 23, and the can bottom 3 is inserted and centered into a recess 28 in the bottom of the holder basket 22. Then, the nut 13 is first loosened from the upper end of the tie rod 5 and the can top 2, with the can jacket 4 welded thereto, the nut is lifted from the can bottom 3, removed from the holder basket 22, and transported to the side. Then the nut 12 on the upper end of the tie rod 5 is loosened and the sheath 10 with the push plate 11 is removed from the tie rod 5 with the aid of another manipulator gripper and transported to the side.

Subsequently, a cluster of fuel rods with spent nuclear fuel in tight packing is mounted vertically onto the inside of the can bottom 3 in the holder basket 22 with a non-illustrated tight-setting device, and retained in this tight packing by means of the pressure strips 25 on the piston rods 24 extended out of the cylinders 23. If necessary, the tie rod 5 can also readily be screwed out of the flanged nut 6 first and removed from the can bottom 3, and later, like fuel rods 27, can be re-mounted upon the can bottom 3 with the tight-setting apparatus and screwed into the flanged nut 6 on the can bottom 3.

Then the manipulator gripper, with the sheath 10 suspended from it and including the push plate 11, is moved to a location above the holder basket 22, and the sheath 10 is again pushed over the upper end of the tie rod 5 and secured on the tie rod 5 by screwing the screw 12 thereon.

Next, the manipulator gripper 26 with the can top 2 and the can jacket 4 is moved to a location above the holder basket 22, and as shown in FIG. 4 the can jacket 4 is pushed from top to bottom over the cluster of tightly packed fuel rods 27 in the holder basket 22. In this process, the piston rods 24 carrying the pressure strips 25 are moved successively from top to bottom into the cylinders 23, in each case shortly before the lower end or in other words the bottom end of the can jacket 4 has reached the associated pressure strips.

Finally, the can jacket 4 is folded over on the can bottom 3, and the manipulator gripper 26 disconnected from the can top 2. The nut 13 with the securing plate 14 is then screwed back onto the upper end of the tie rod 5.

Figure 5:
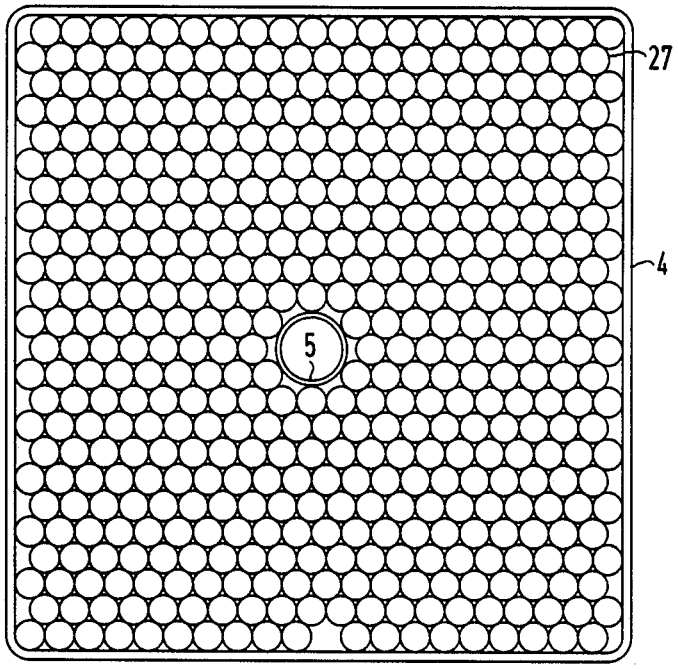
FIG. 5 is a cross-sectional view of a can of FIGS. 1–5, with fuel rods tightly packed therein.

As is shown in FIG. 5, in which identical elements are provided with the same reference numerals as in FIGS. 1–4, the can of FIGS. 1–3 is filled with fuel rods 27 in a tight packing. The can can then be removed from the holder basket 22 with the manipulator gripper 26, and transported elsewhere. In this case the load-bearing element of the can is the tie rod 5, which if necessary may also have a decentralized position as suggested in FIG. 5.

In order to empty the can of FIGS. 1–3 which is filled with tightly packed fuel rods 27, the nut 13 need merely be loosened from the upper end of the tie rod 5 and the can top 2 and can bottom 3 pulled apart with manipulator grippers.

This is advantageously performed in a tub, in which the can of FIGS. 1–3 is located, so that the fuel rods pushed out of the can jacket 4 by the push plate 11 drop directly into the tub. Subsequently, the can can be reassembled, by placing the can top and empty can jacket 4 back on the tie rod 5 and screwing the nut 13 back onto the upper end of the tie rod 5.

Subsequently, the flanged nut 6 is unscrewed from the bottom end of a can of FIGS. 1–3 while filled with fuel rods 27 and after the can bottom 3 is lifted from the can, which is standing on its head, with the aid of a manipulator gripper that grips the can bottom 3 from behind in openings 30 in the jacket 3*b*, individual fuel rods 27 can then be removed from the can as needed with a suitable pulling tool. Subsequently, by mounting the can bottom 3 on the bottom end of the tie rod 5 and tightening the flanged nut 6, the can can be closed once again.

The can top 2, push plate 11 and the bottom end of the can jacket 4 can be provided with flow openings 32 and 33 for a coolant, for dissipating the residual heat of decay that the fuel rods inserted into the can of FIG. 1–3 are capable of giving off.

The foregoing is a description corresponding in substance to German Application No. P 38 11 104.7, dated Mar. 31, 1988, the International priority of which is being claimed for the instant application, and which is hereby made part of this application. Any material discrepancies between the foregoing specification and the aforementioned corresponding German application are to be resolved in favor of the latter.

I claim:

1. Can for receiving a cluster of fuel rods containing nuclear fuel, comprising a can top, a can jacket secured on said can top, a can bottom loosely covered by said can jacket, said can top having a lower surface facing said can bottom, a tie rod disposed inside said can jacket, a push plate disposed inside said can jacket at a right angle to said tie rod, said tie rod extending loosely through said push plate and having an upper end releasably secured to said can top and a lower end secured to said can bottom, and a stop body releasably attached to said upper end of said tie rod at said lower surface of said can top for stopping movement of said push plate inside said can jacket.

2. Can according to claim 1, wherein said tie rod is releasably secured to said can bottom.

3. Can according to claim 1, wherein said stop body is a nut screwed onto said tie rod.

4. Can according to claim 1, wherein said can top has an upper surface, and said tie rod extends loosely through said can top, and including a nut screwed on said upper end of said tie rod on said upper surface of said can top for retaining said tie rod.

5. Can according to claim 2, wherein said can bottom has an outer surface, and including a flanged nut screwed on said lower end of said tie rod, said flanged nut having a flange resting on said outer surface of said can bottom, and a pin engaging inside said flange and inside said can bottom for securing said flanged nut against twisting.

6. Can for receiving a cluster of spent fuel rods containing nuclear fuel, comprising a can top, a can jacket secured on said can top, a can bottom loosely covered by said can jacket, said can top having a lower surface facing said can bottom, a tie rod disposed inside said can jacket, means in the form of a push plate disposed inside said can jacket at a right angle to said tie rod for pushing spent fuel rods out of the can jacket, said tie rod extending loosely through said push plate and having an upper end releasably secured to said can top and a lower end secured to said can bottom, and a stop body releasably attached to said upper end of said tie rod at said lower surface of said can top for stopping movement of said push plate inside said can jacket.

* * * * *